US006631754B1

(12) United States Patent
Bremont et al.

(10) Patent No.: US 6,631,754 B1
(45) Date of Patent: Oct. 14, 2003

(54) REGENERATIVE HEAT EXCHANGER AND METHOD FOR HEATING A GAS THEREWITH

(75) Inventors: Marc Bremont, Jouy en Josas Cedex (FR); Karin Tynelius-Diez, Jouy en Josas Cedex (FR); Nicolas Perrin, Champigny sur Marne Cedex (FR); Philippe Queille, Paris (FR); Joël Pierre, Champigny sur Marne Cedex (FR); Michel Poteau, Champigny sur Marne Cedex (FR)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/525,115

(22) Filed: Mar. 14, 2000

(51) Int. Cl.[7] ..... F28D 17/00
(52) U.S. Cl. ..... 165/10; 165/4
(58) Field of Search ..... 165/4, 8, 155, 165/9.1–9.4; 431/117, 215

(56) References Cited

U.S. PATENT DOCUMENTS

| | | | | | |
|---|---|---|---|---|---|
| 2,272,108 | A | | 2/1942 | Bradley | |
| 3,436,064 | A | * | 4/1969 | Hauth et al. | 165/9.1 |
| 3,591,153 | A | * | 7/1971 | Powell et al. | 165/9.3 |
| 4,150,717 | A | * | 4/1979 | Balke et al. | 165/9.1 |
| 4,378,045 | A | * | 3/1983 | Balke et al. | 165/9.3 |
| 5,052,918 | A | * | 10/1991 | Fassbinder | 165/4 |
| 5,547,016 | A | | 8/1996 | Fassbinder | |
| 5,577,553 | A | | 11/1996 | Fassbinder | |
| 5,690,164 | A | | 11/1997 | Fassbinder | |
| 5,924,477 | A | * | 7/1999 | Doru | 165/9.1 |

FOREIGN PATENT DOCUMENTS

| | | |
|---|---|---|
| DE | 41 08 744 | 8/1992 |
| DE | 195 47 978 | 7/1997 |
| DE | 195 21 673 | 7/1998 |

* cited by examiner

*Primary Examiner*—Christopher Atkinson
(74) *Attorney, Agent, or Firm*—Burns, Doane, Swecker & Mathis, L.L.P.

(57) ABSTRACT

Provided is a novel regenerative heat exchanger and a method for heating a gas in the heat exchanger. The regenerative heat exchanger features a chamber separated into a plurality of annular concentric spaces, including: a first, inner annular space defining a hot collection chamber; a second, outer annular space concentric to and around the first space defining a cold collection chamber; and a third annular space defining a heat exchange zone concentric to and between the first and second spaces. The heat exchange zone contains a particulate heat transfer material. The third space is supported on the inside by a concentrically disposed hot grid, and the external diameter of the third annular space is less than about double the internal diameter of the third annular space. The invention has particular applicability to the feeding of hot blast to a blast furnace in the iron making industry.

27 Claims, 10 Drawing Sheets

Gas phase: expansion of the bed

Blast phase: retraction of the bed

REGENERATIVE HEAT EXCHANGER AND METHOD FOR HEATING A GAS THEREWITH

BACKGROUND OF THE INVENTION

1. Field of the Invention

The invention relates to a regenerative heat exchanger and to a method for heating a gas in the regenerative heat exchanger The invention has particular applicability to the feeding of hot blast to a blast furnace in the iron making industry.

2. Description of the Related Art

Regenerative heat exchangers operate by passing a stream of a relatively hot gas through a heat exchange mass during one period (gas phase) to store heat in the mass. A stream of a relatively cool gas is subsequently passed in the reverse direction through the mass during a second period (blast phase) to recapture this stored heat. With heat exchangers of this type, it is customary to have the gas phase and the blast phase alternately recur, and to provide at least two heat exchange masses. In this way, while heat is being stored in one of the masses, heat can be recovered from the other mass. The refractory brick lined hot stove used in the iron making industry to feed blast furnaces with hot blast is one such example of a regenerative heat exchanger.

In some industries, such regenerative heat exchangers are referred to as hot stoves. Depending on the particular industry, multiple heat exchanger configurations may be preferred. For applications in which more than two heat exchangers of this kind are used, various phase setups may be implemented. Certain of these setups have been widely implemented in the industry with development having taken place over a long period of time. One such example is the refractory brick lined hot stove used in the iron making industry to feed blast furnaces with hot blast.

Problems associated with the conventional refractory brick lined regenerator are primarily inherent in the design of the regenerator itself. For example, these units are typically very tall and not compact. As a result of this large size, the cost of the units is very high.

The large size of the conventional regenerator can also lead to significant losses in system availability. In particular, when the operating pressure of the heat exchanger during the gas phase is lower than that during the blast phase, a pressurization period must be inserted after the gas phase and before the blast phase, and a depressurization period added after the blast phase and before the gas phase. During the depressurization phase, an amount of hot blast proportional to the unit volume is released into the atmosphere. This increases the heat losses of the regenerator by the heat quantity Q, according to the following equation:

$$Q = \frac{C_P(T_{Blast} - T_{Ref}) \cdot (P_{Blast} - P_{Gas}) \cdot V_{Stove}}{RT_{Blast}}$$

wherein:

Q is the heat loss during inversion phase (J)

$C_p$ is the molecular heat capacity ($J.mol^{-1}.K^{-1}$)

$T_{Ref}$ is the reference temperature (K)

$T_{Blast}$ is the blast temperature (K)

$P_{Blast}$ is the operating pressure during the blast phase (Pa)

$P_{Gas}$ is the operating pressure during the gas phase. (Pa)

$V_{Stove}$ is the free inner volume of the regenerator unit ($m^3$), and

R is the ideal gas constant (8.314).

The periods for such phases, termed inversion phases, are longer with increased apparatus volumes. System availability is thus decreased as a result of the large size of the conventional systems.

In addition to reduced system availability during the inversion phases, further loss of availability results during system startup and shutdown. The refractory bricks, or checkers, lining the regenerator are typically constituted of a heat resistant masonry that is subject to thermal shock under high temperature variation over time. This particular design requires a very cautious and time consuming startup and shutdown. The time needed to start a new regenerator, i.e., to bring the temperature of the refractory lining to operating temperature, can be as long as one month. This period of time is required in order to safely dry the refractory masonry and to heat it up. The same caution must be applied to shutting down of the regenerator. To avoid deterioration of the refractory bricks of the regenerator, the cooling rate applied must stay within a given range depending on the nature of the refractory. These factors can significantly affect system availability.

In continuous processes, two or more regenerative heat exchangers are cyclically operated. The combination of the required inversion periods and the limitation on heating and cooling rates for the refractory checkers make it unrealistic, if not impossible, to use short cycle times (e.g., a two hour or less gas phase and a one hour or less blast phase). While modern equipment does allow for lessening of cycle times, practical limitations prevent the avoidance of inversion losses.

To overcome some of the disadvantages of conventional refractory lined hot stoves, regenerative heat exchangers of different geometrics have been proposed. One new design has drawn particular attention. Such regenerative heat exchangers are typically cylindrical in structure, and include a heat accumulation mass which consists of a loose bulk material arranged in a space and held in place between two concentric walls (i.e., an inner hot grid and an outer cold grid) which are permeable to gases. Regenerators of this type are disclosed, for example, in U.S. Pat. No. 2,272,108, U.S. Pat. No. 5,690,164 and U.S. Pat. No. 5,577,553. In the heat exchanger, a hot collection chamber is circumscribed by the inner hot grid for collecting the hot gases. A cold collection chamber for collecting the cooled gases is typically defined by the space between the outer cold grid and the external wall of the regenerator.

The quantitative embodiment described in U.S. Pat. No. 2,272,108, to Bradley, cannot operate in practice. The gas speed selected for passing through the heat accumulation mass is much too small while the size of the particles making up the loose bulk material of the heat accumulation mass is too large. This results in an inadequately small head loss of the gas in the material bed. The pressure of the gas thus decreases with height in the cold collection chamber. This effect, known as the "stack effect", is negligible in the hot collection chamber. The pressure difference caused by the stack effect is a multiple of the pressure drop in the material bed. Consequently, when heating the regenerator, the heating gases flow only in the upper region through the material bed. Backflow of the gases might even be expected in the lower region. When working under hot blast, i.e., during cold blowing, the conditions are reversed. That is to say that only the lower region of the material bed would be exposed to the gases. These results lead to the conclusion that the regenerator described in this document would necessarily fail.

Further problems associated with heat exchanger design and the aforementioned stack effect concern the hot grid structures and their tendency to accumulate dust. As a result of dust accumulation, flow of the gas through the grid is inhibited during the blast and gas phases. This results in an increase in pressure drop through the brick and heat accumulation bed.

The main concern regarding dust loading of the gas stream is plugging of the openings of the bricks in the grid, as well as sticking of the particles in the heat accumulation bed. It has been found that particles in direct proximity to the hot grid openings tend to become coated by a hard, sintered layer of dust. This dust layer acts as a cement, binding the particles together in the regions close to the hot grid openings. As a result, the porosity of the heat accumulation bed becomes decreased, and the pressure drop through the bed increases. This phenomenon is particularly detrimental to the heat transfer efficiency of the heat exchanger.

Moreover, the high operating temperatures and thermal cycles experienced by the hot grid place extreme demands on that structure. In this respect, the succession of blast phase and gas phase cycles submits the hot grid to repeated stress cycles. The mechanical stress under which the bricks and hot grid can operate is generally limited by its weak point. Such a weak point typically occurs each time an important structural change in the brick occurs. The junction between the structures is often a potential crack development location.

U.S. Pat. No. 5,577,553, to Fassbinder discloses a hot grid made up of individual bricks composed of a heat resistant material, such as ceramic. The bricks have a cavity which opens into an annular chamber containing the heat-storage medium. The cavity is filled with pellets which are mutually consolidated and secured against dropping out of the brick by a heat resistant adhesive. A blind-hole bore, starting from the wall of the brick adjacent to the hot collecting chamber enclosed by the hot grid, extends into the cavity filled with the pellets. The disclosed brick, however, is disadvantageous in that its structure is complicated and is made of numerous pieces. The brick is thus more subject to stress build up and breakage is possible, especially at the junction between pellets and between pellets and brick. The adhesive material which glues the pellets together must withstand high stresses. Moreover, the production of such a brick is not easy and induces high costs.

It is an object of the present invention to provide a regenerative heat exchanger which avoids or conspicuously ameliorates the problems associated with the state of the art.

It is a further object of the invention to provide a method for heating a gas with the regenerative heat exchanger system.

The regenerative heat exchanger and method for heating a gas in accordance with the invention allow for shorter start up and shut down times, shorter cycle times and lower heat losses during inversion periods compared with conventional systems. The invention further results in lower cost for the unit as well as lower operational costs compared to conventional regenerators. Improved distribution of the gases passing through the heat accumulation bed is such that flow rate and other characteristics of the gas depend only on the radius of the point at which it is measured in the bed, and not on the height of the bed or the angle of flow.

SUMMARY OF THE INVENTION

Provided is a regenerative heat exchanger which features a chamber separated into a plurality of annular concentric spaces, comprising: a first, inner annular space defining a hot collection chamber; a second, outer annular space concentric to and around the first space defining a cold collection chamber; and a third annular space defining a heat exchange zone concentric to and between the first and second spaces. The heat exchange zone contains a particulate heat transfer material. The third space is supported on the inside by a concentrically disposed hot grid, and the external diameter of the third annular space is less than about double the internal diameter of the third annular space.

In accordance with a further aspect of the invention, a regenerative heat exchanger is provided which features a chamber separated into a plurality of annular concentric spaces, which include: a first, inner annular space defining a hot collection chamber; a second, outer annular space concentric to and around the first space defining a cold collection chamber; and a third annular space defining a heat exchange zone concentric to and between the first and second spaces. The heat exchange zone contains a particulate heat transfer material, wherein the third space is supported on the inside by a concentrically disposed hot grid. A combustion chamber is at least partially disposed within the hot collection chamber.

In accordance with further aspects of the invention, methods for heating a gas in the inventive regenerative heat exchangers are provided. The methods involve passing a hot gas from the first annular space through the hot grid and the third annular space, thereby heating the heat transfer material, and subsequently passing a gas to be heated from the second annular space through the third annular space and the hot grid into the first annular space, thereby heating the gas to be heated.

BRIEF DESCRIPTION OF THE DRAWINGS

The objects and advantages of the invention will become apparent from the following detailed description of the preferred embodiments thereof in connection with the accompanying drawings, in which like numerals designate like elements, and in which.

DETAILED DESCRIPTION OF THE PREFERRED EMBODIMENTS OF THE INVENTION

Figure 1:
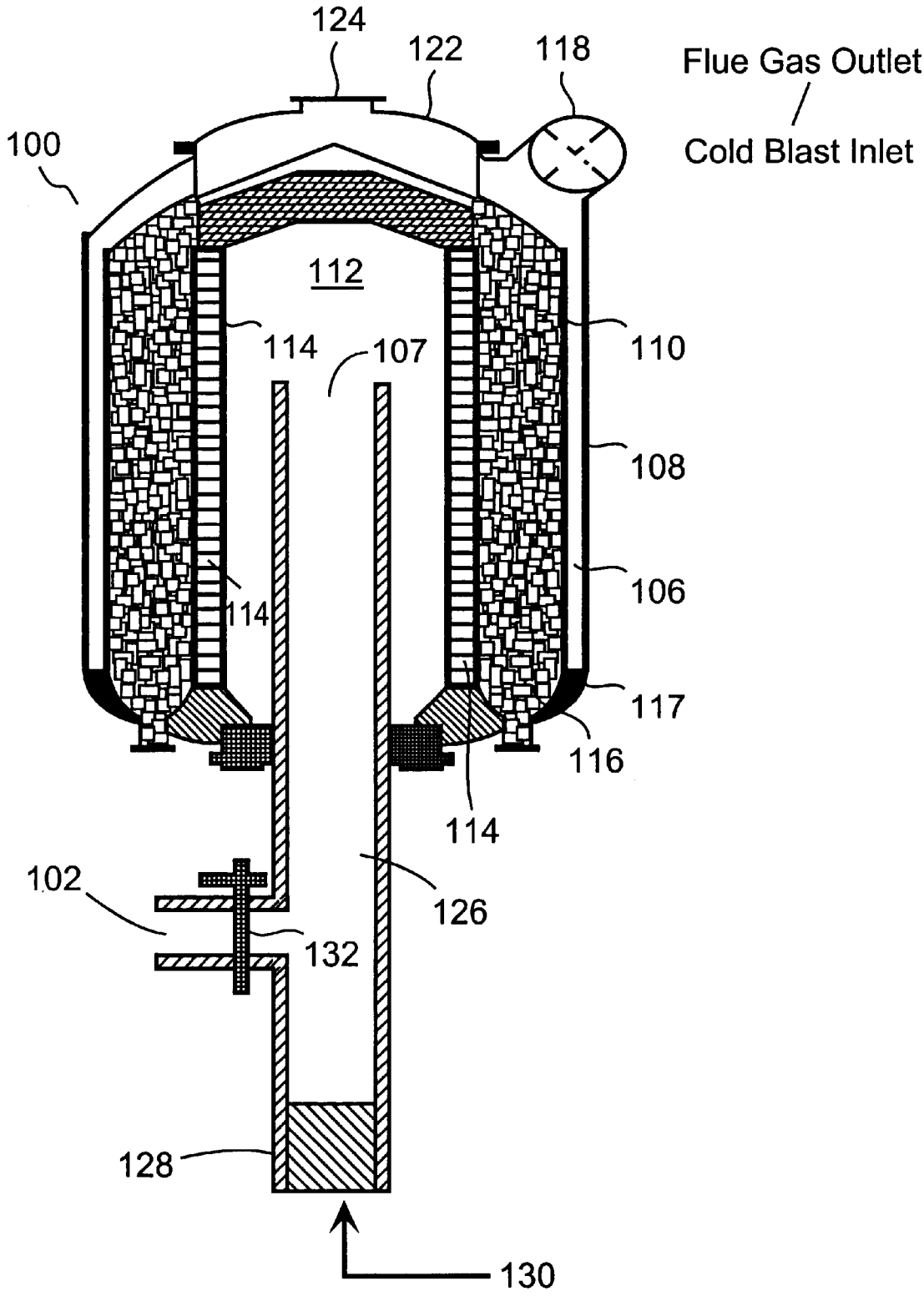
FIG. 1 illustrates in cross-section an exemplary regenerative heat exchanger in accordance with the invention.

The success of a heat accumulation mass as a heat transfer medium in a regenerative heat exchanger can be achieved if the aforementioned stack effect is prevented. Thus, the hot gas flow in the gas phase and the blast stream in the blast phase should be evenly distributed in the bed. In a cylindrically shaped unit, the hot gas and the blast should flow radially and evenly throughout the height of the bed to ensure that the heat transfer at a given radius is uniform throughout the height of the bed. The distance between the hot grid and the cold grid (i.e., the thickness of the bed) as well as the particle size of the bed material are the main parameters influencing pressure drop in the bed, which is of paramount importance when considering the stack effect.

The pressure drop of the gas in the bed is calculated by integration of the Ergun equation along the bed thickness according to the following formula:

$$\frac{\Delta P}{L} = 150 \cdot \frac{(1-\varepsilon)^2}{\varepsilon^3 \cdot d_{car}^2} \cdot \mu \cdot V + 1.75 \cdot \frac{(1-\varepsilon)}{\varepsilon^3 \cdot d_{car}} \cdot \rho \cdot V^2$$

wherein $\Delta P$ is the pressure drop of the gas through the bed

L is the length, or thickness, of the bed $\epsilon$ is the void fraction of the bed $d_{car}$ is the characteristic diameter (diameter of a sphere having the surface of the average specific surface of the bed)

$\mu$ is the dynamic viscosity of the gas

V is the velocity of the gas in an empty section, and $\rho$ is the volumetric weight.

From this equation, it can be seen that the particle diameter and the thickness of the bed are variables strongly influencing the pressure drop.

To minimize or eliminate the stack effect, it is advantageous for the difference$\Delta^{2p}$, which is the pressure drop of the regenerator at the end of the gas phase ($\Delta P_{hot}$) minus the pressure drop of the regenerator at the start of the gas phase ($\Delta P_{cold}$), to be large compared to $\rho \cdot g \cdot H$. Quantitatively, it is advantageous to try to satisfy the following equation:

$$10 \leq \frac{\Delta^{2p}}{\rho \cdot g \cdot H} \leq 20$$

wherein $\Delta^{2p}$ is as defined above, $\rho$ is the volumetric weight of the gas at a temperature of 20° C. in kg.m$^3$, g is the gravitational constant in m.s$^{-1}$, and H is the height of the regenerator in m.

To achieve this condition, experiments and calculations have shown that the external diameter of the annular heat accumulation mass (equal to the inner diameter of the annular cold grid) is preferably less than about double its internal diameter (equal to the outer diameter of the annular hot grid) for a particle diameter of the bed material which is less than about 20 mm.

Typically, the regenerators in accordance with the invention have a diameter of from about 3 to 8 m, and a height of from about 3 to 20 m, for example a diameter of about 4 meters and a height of about 5 meters. In contrast, conventional air heaters of the same power require a significantly larger size, for example, with a diameter of about 8 meters and a height of 30 meters.

FIG. 1 illustrates an exemplary regenerative heat exchanger 100 in accordance with a first embodiment of the invention. The regenerative heat exchanger 100 allows a process to be carried out which involves recovering the heat from a hot gas stream during a gas phase, and transferring the heat to a flow of cold blast to be heated during a blast phase. The regenerative heat exchanger 100 includes a hot gas inlet 107 and a flue gas outlet 118 for use during the gas phase, and a cold blast inlet 118 and a hot blast outlet 102 for use during the blast phase. The flue gas outlet and the cold blast inlet 118 can be separate openings or share the same common orifice (as shown) in the shell of the apparatus. Similarly, the hot gas inlet 107 and the hot blast outlet 102 can either be separate openings or share the same common orifice. In the case of a common orifice for either or both of the inlet/outlet pairs, a piping and valve system can be installed after the common opening(s) for the individual flows.

Each of these inlets and outlets can be provided with a suitable system of valves, actuators and other flow control devices to control the flow rate and pressure of the streams passing therethrough. Flow control of the various stream can be accomplished automatically by use of flow control devices and valves in combination with a suitable controller, for example a programmable logic controller (PLC).

The apparatus is preferably cylindrical in shape and is divided into at least three annular concentric spaces. First annular space (outer or cold collection chamber) 106, is located between outer shell 108 of the apparatus and an outer, annular cold grid 110. Second annular space (inner or hot collection chamber) 112 is the area of the apparatus within an inner, hot grid 114. The second annular space is generally located in the central region of the unit and is typically cylindrical in shape. Third annular space 116 defines a bed area between cold grid 110 and hot grid 114. The bed can be in a single space as shown or can be divided into a plurality of compartments by intermediary annular grids (not shown).

The bed contains a heat accumulation mass 117 which acts as the heat transfer means. This accumulation mass 117 is made up of a loose bulk material in particle form which is packed into the third annular space 116 of the bed. Depending on the requirement of the application, this bulk material can be of spherical, oval or even irregular shape. Advantageously, the particle size of the loose bulk material is selected to be less than about 20 mm. The material is selected to withstand high temperature variations over short periods of time. The small diameter of the bulk material is beneficial to its thermal shock resistance. Suitable types of heat accumulation particles include, for example, alumina pellets/balls, MgO pellets/balls, gravel or lava for lower duty.

The hot gas acting as the heat source during the gas phase may come from the hot combustion products of a combustible gas, for example, as shown in FIG. 1. This combustion can take place, for example, in a combustion chamber 126 designed to burn suitable quantities of a combustible matter so as to provide the process with sufficient heat. A burner 128 is operated only during the gas phase to produce the heat required by the process. This combustible matter can be, but is not limited to, natural gas, propane, butane, methane, blast furnace gas, converter off-gas, coke oven gas, other combustible gas, fuel oil, coal or combinations thereof. The oxidizing gas is supplied to the burner 128 through oxidizing gas inlet 130 and can be, for example, air, industrially pure or impure oxygen, oxygen enriched air or combinations thereof.

The combustion chamber 126 is a refractory-lined space which includes a combustion unit designed to burn the combustible gases with a sufficiently high power density to make the chamber as small as possible. Chamber 126 is preferably designed such that the combustion is carried out completely therein. As illustrated, combustion chamber 126 can be at least partially within the hot collection chamber. In some cases, the size of the combustion chamber is determined by the length of the flame and may even be greater than the height of the regenerator itself. However, to minimize the cost of the regenerator unit, the size of the flame should be kept as small as possible.

Since the design of the regenerator provides an empty space in the middle of the unit, at least a portion of the combustion chamber 126 is preferably disposed in the empty space of the hot collection chamber 112 in the regenerator. As a result of the combustion chamber being at least partially disposed within the hot collection chamber, a very compact unit size and thus a lower investment cost result. The combustion chamber can optionally be disposed very close to, or directly connected to, the hot gas inlet of the regenerator.

In the gas phase, the hot flue gas produced by the combustion is collected and evenly distributed in the space between the wall of combustion chamber 126 and hot grid 114. This feature provides important advantages to the invention. For example, the length of combustion chamber 126 can be properly set as required to achieve a proper combustion efficiency within the combustion chamber without unreasonably increasing the height of the regeneration unit. In addition, because the pressure drop encountered by the hot gas and the blast gas primarily occurs in the heat accumulation bed, uniformity of the gas flow is not affected by the presence of the combustion chamber inside the hot blast collection chamber 112.

The hot blast outlet 102 can be located either in the combustion chamber 126 or at another location in the regenerator. The former case is illustrated in FIG. 1, in which the hot blast enters the idle combustion chamber 126 and exits the regenerator through an opening in the wall of the combustion chamber. The hot blast gas is removed from the combustion chamber through the hot blast outlet 102, which is connected to the wall of the combustion chamber, while a hot blast valve 132 is open. The hot blast is directed it to its point-of-use through a suitable valve and piping system, which includes flow control devices.

To easily collect the particles of the heat accumulation bed which may fall from the openings of the hot grid, an opening can optionally be provided at the bottom of the space between hot grid 114 and the combustion chamber wall.

To prevent heat leaking outside of the unit from inner, hot collection chamber 112, the top of the chamber is preferably sealed tightly by an insulating lid 122 made of a heat resistant material. The function of lid 122 is to prevent hot gas during the gas phase or hot blast during the blast phase from exiting the unit without having properly traveled through bed 116. Lid 122 should further prevent heat loss from the chamber through conduction within the lid itself. The material selected for lid 122 should therefore have a low heat conductivity and be installed in a manner which allows the hot grid to expand freely in the vertical direction (through thermal expansion) and which prevents the bed material from leaking into the hot collection chamber. Suitable materials which can be used for the insulating lid include, for example, such as refractory ceramics or cements.

Figure 2:
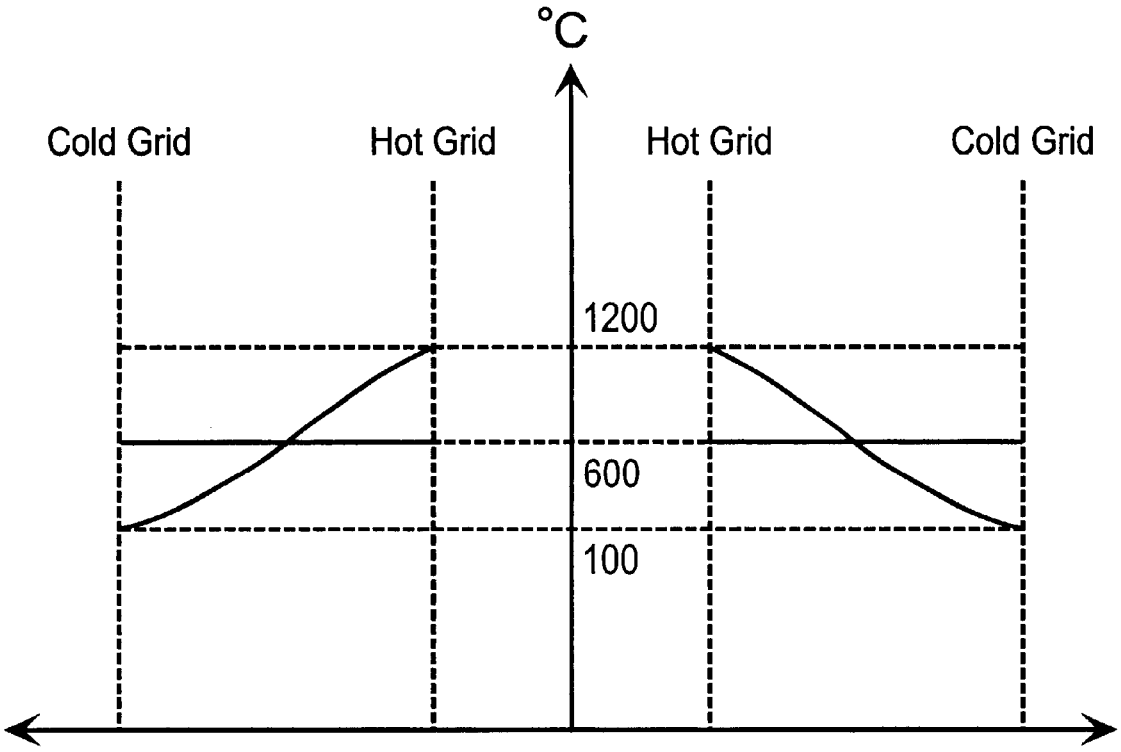
FIG. 2 is a graph illustrating a bed temperature profile at equilibrium.

In the case of a failure of the equipment supplying the unit with cold blast, such as a blower, fan, valve, etc., the heat stored in the heat accumulation bed 116 is preferably released from the unit to the atmosphere to maintain integrity of the unit. Leaving the regenerator idle in such a case, the temperature gradient in the heat accumulation bed (cold outside, hot inside) would tend towards equilibrium (see FIG. 2). The temperature of the cold grid and the outer shell would then increase by, for example, from about 300 to 700° C. As these components are designed to stay at much lower temperatures, for example, from about 30 to 400° C., they would not be expected to retain their integrity under such a high thermal load. The failure of these components would inevitably result in critical damage to the unit. Heat release can be accomplished by use of a controller, for example, a PLC, which opens the lid or a portion thereof in response to a sensed abnormality. The sensed abnormality can be, for example, a stoppage or low flow of the cold blast flow, or a high temperature level in the regenerator.

To avoid this occurrence, the lid 122 covering the hot grid can be provided with an opening 124. This opening can be connected to a stack or a flare with a suitable set of valves, piping and flow control devices. If the cold blast feed should fail, this opening can be opened and heat released from the bed into the atmosphere through natural convection of ambient air in the unit. This opening can also be connected to the point-of-use of the hot blast and thus be used as the hot blast outlet of the regenerator if desired. In addition, suitable gas piping and valves can be installed in a manner which allows the hot blast feed to the regenerator to be cut off whenever such a safety procedure is followed.

Figure 3:
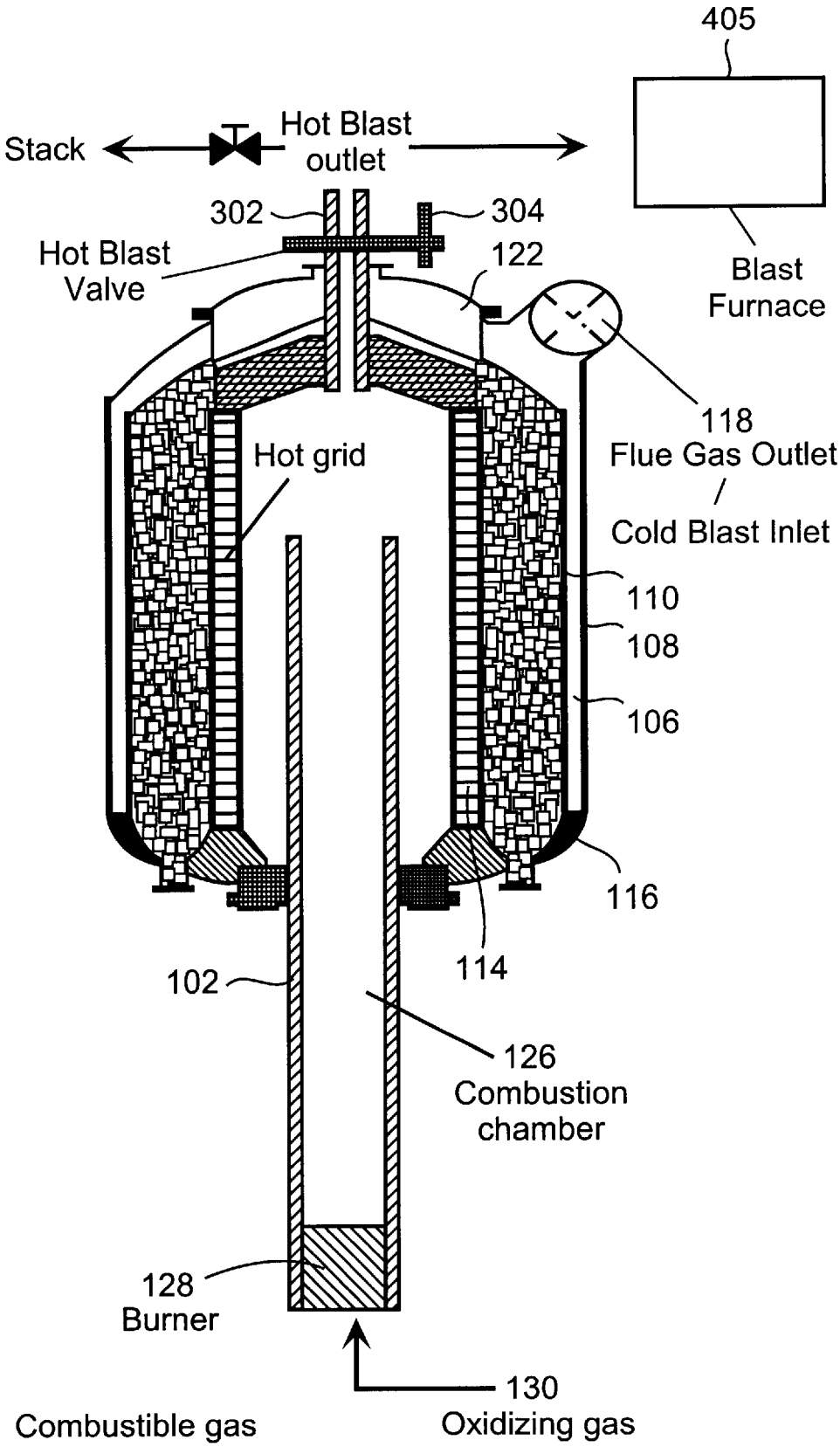
FIG. 3 illustrates in cross-section an exemplary regenerative heat exchanger in accordance with the invention.
Figure 4A:
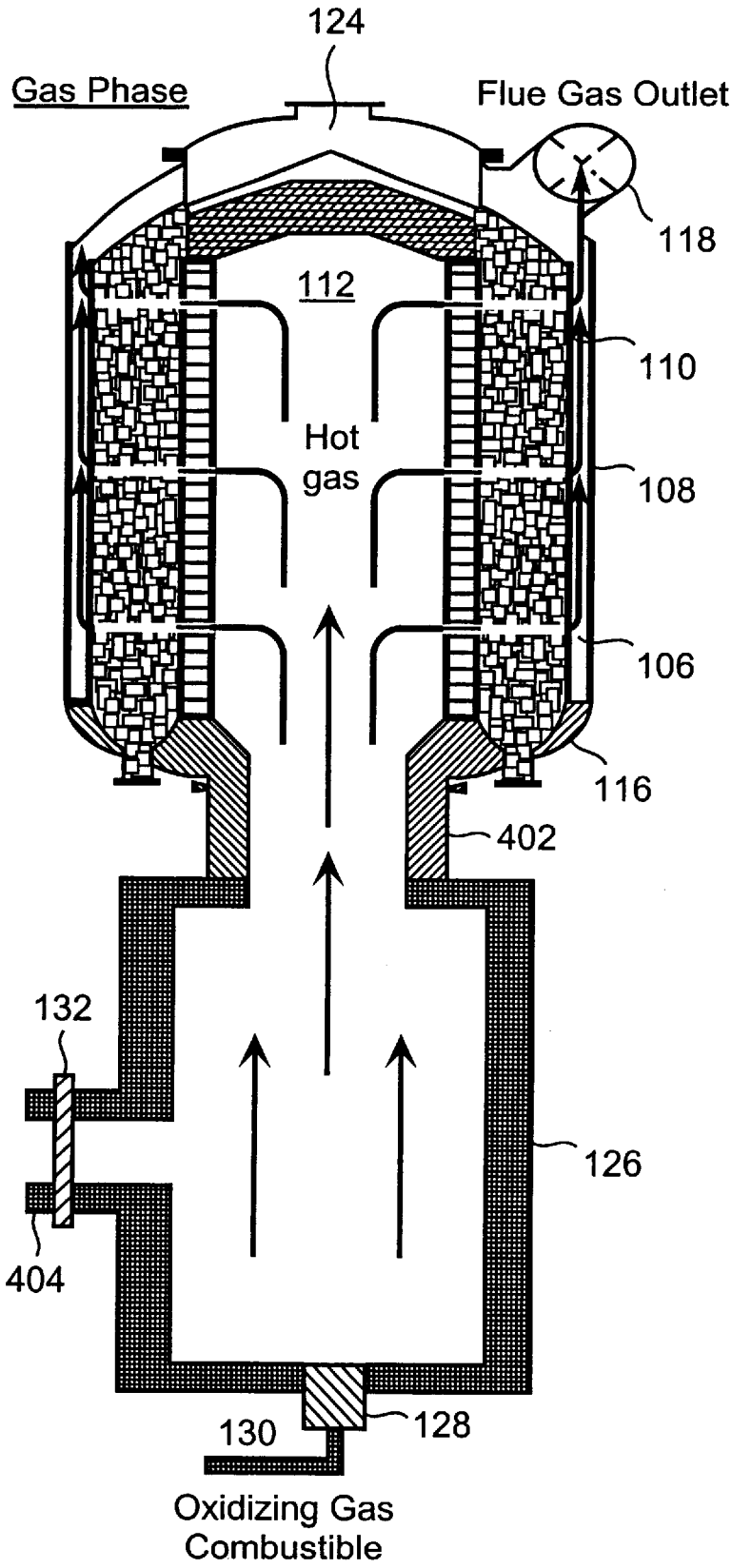
FIGS. 4A and 4B illustrate in cross-section a regenerative heat exchanger in accordance with the invention during a gas phase and a blast phase, respectively.
Figure 4B:
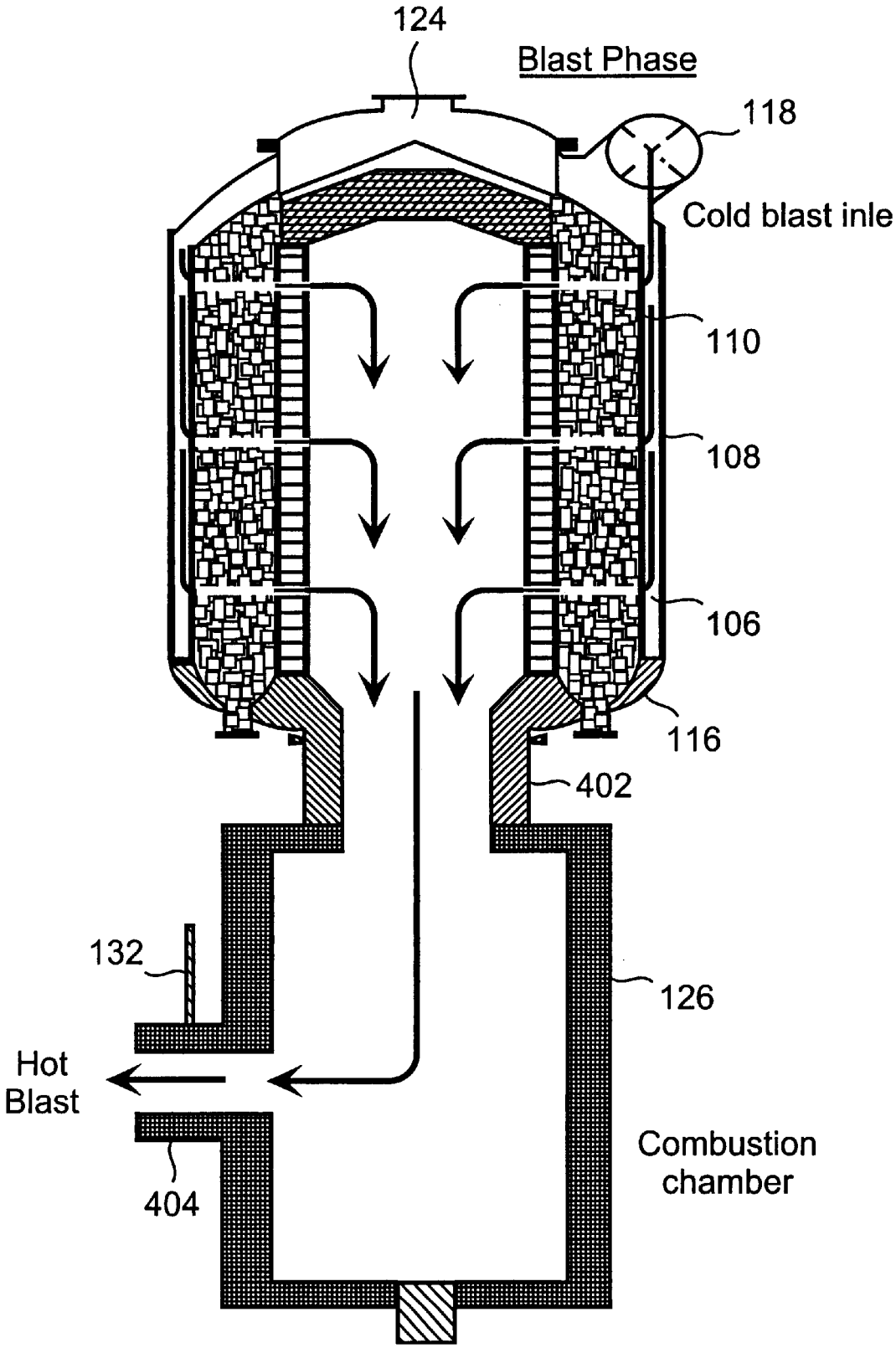

Additional exemplary regenerator systems in accordance with the invention are illustrated in FIGS. 3, 4A and 4B. The embodiment shown in FIG. 3 allows for the hot blast to exit the regenerator through a hot blast outlet 302 in the regenerator separate from the combustion chamber. As illustrated, hot blast outlet 3-02 can be provided through lid 122. The hot blast valve 304 in this case would typically be disposed at the hot blast evacuation opening 304 from the combustion chamber. The hot blast can then be fed to a blast furnace 405.

FIGS. 4A and 4B illustrate a regenerator in accordance with a further embodiment of the invention during the gas phase and blast phase, respectively, in which the combustion chamber 126 is disposed and below hot collection chamber 112. The combustion chamber outlet 402 is shown as being directly connected to or the same as the hot gas inlet (FIG. 4A). The hot gas enters hot collection chamber 112 through outlet 402.

As shown in FIG. 4B, the blast enters the idle combustion chamber 126 through hot blast outlet 402 during the blast phase. The hot blast flow then exits the combustion chamber through an additional opening 404 in the wall of the combustion chamber designed to evacuate the hot blast and direct it to its point-of-use through a suitable valve, piping and flow control.

In another embodiment of the invention, the combustion chamber can be disposed beneath the apparatus in a vertical position. In certain applications, for example, hot blast production for a blast furnace, the existing design of the hot stove is such that the hot blast main, dedicated to the collection of the hot blast, is located at a height of greater than about 4 meters. To integrate the apparatus with minimum tie-in work to the existing, it is beneficial to build a vertical combustion chamber under the apparatus. This particular design will put the hot blast outlet at about the altitude of the existing blast main, minimizing the need for expensive refractory lined duct work. Alternatively, the combustion chamber can be horizontally disposed, built at the foot of the apparatus.

As an alternative to the use of a combustion chamber, the heat for the process can be provided by a combustible gas burned inside the heat exchange apparatus itself. In such a case the unit would include a combustible gas inlet, an oxidizing gas inlet and a suitable flow rate and pressure control. The oxidizing gas is preferably air, industrially pure or impure oxygen, oxygen enriched air or a combination thereof. To provide a very high power release density in the flame, a special burner design is used. The flame is preferably as short as possible to ensure that it stays within the inner hot collection chamber which, in this embodiment, also serves as the combustion chamber. The preferred design for this burner is a premix burner, in which oxidizing gas and a combustible gas are intimately mixed together before being ignited. Such a design produces a very intense and short flame, making it particularly suitable for this application.

A method of use of the regenerative heat exchangers in accordance with the invention will now be described with reference to FIG. 1. To begin a cycle of the apparatus starting with the gas phase, a valve in the flue gas outlet 118 and a valve in the hot gas inlet 107 are opened to allow the hot gas stream to flow through the hot gas inlet 107 and through bed 116. In units in which the heat is provided by a burner, whether in the apparatus itself or in a separate combustion chamber, an oxidizing gas valve is opened and flow of the combustible to the combustion chamber is then started. Ignition of the flame is accomplished by means of a pilot burner or auto-ignition of the combustible at the point of contact with the hot portions of the apparatus. In the case of auto-ignition, a temporary ignition device can be installed for start up of the unit.

During the gas phase, the hot gas enters the regenerative heat exchanger through hot gas inlet 107 and is collected in the inner hot collection chamber 112. The hot gas is distributed in bed 116 through hot grid 114 in such a way that its flow rate depends only on the radius of the point at which it is measured in the bed, and not on the height of the bed or the angle of flow. The gas flows radially outward through the heat exchange bed 116. As the gas passes through the bed, it transfers its heat to the bulk material of the bed. The cooled gas exits bed 116 through cold grid 110, and is collected in outer cold collection chamber 106. The gas is then directed to flue gas outlet 118 from which the gas exits the apparatus. The gas phase is ended when the requisite amount of heat is stored in the bed. Typically, a preset time period is assigned to the gas phase cycle with the hot gas flow rate being selected based on such time.

At the end of this cycle, the first inversion phase begins by closing the hot gas inlet valve by shutting off the burner. Where the heat is provided by combustion, the combustible flow is turned down followed by shutting off the oxidizing gas flow. The flue gas valve is next closed. Immediately after closing the flue gas valve, the cold blast inlet valve is opened, thereby allowing the cold blast which is to be heated to enter the apparatus. The pressure during the blast phase is often greater than the pressure during the gas phase. In such a case, a pause is observed before starting the blast phase to allow the pressure in the unit to rise from the gas phase operating pressure to the blast operating pressure. Once the pressure inside the unit has reached the desired level, the hot blast valve 132 is opened and flow of the hot blast from the hot blast outlet is commenced. This marks the beginning of the blast phase.

During the blast phase, the blast to be heated up travels through the bed in a direction opposite to the hot gas previously described with respect top the gas phase. That is, the blast to be heated passes radially inward through the bed, from the cold collection chamber 106 through the cold grid 110 and particle bed 116 and into hot collection chamber 112. The gas is distributed in the heat accumulation bed in such a way that its flow rate depends only on the radial point of the bed at which it is measured, and not on the height or flow angle. In this way, the heat stored in the loose bulk material is recovered by the blast and the blast is thereby heated to the desired hot blast temperature. As the process continues, the hot blast temperature slowly decreases and the amount of heat stored in the bed decreases. At the end of the blast phase, when the temperature of the hot blast reaches its lower level, the second inversion phase begins.

The hot blast valve 132 is closed and the cold blast valve 118 is then closed. If the blast phase is operated under a higher pressure than the gas phase, the flue gas valve can be opened to depressurize the unit down to the gas phase operating pressure by releasing hot blast to the stack. This stage is made sufficiently long to lower the pressure of the unit down to the gas phase operating pressure. A new gas phase then begins as described previously.

Because of the relatively small volume of the regenerative heat exchanger in accordance with the invention compared with conventional units, much shorter inversion times are possible than in conventional hot stoves. Typical inversion phases can last, for example, from a few seconds to a few minutes (e.g., from three seconds to five minutes), depending on the size of the unit, for the inversion phase following the gas phase and before the blast phase, and for about the same time, depending on the size of the unit, for the inversion phase following the blast phase and before the following gas phase. In addition, less hot blast is lost to the stack while bringing down the pressure of the unit at the end of the blast period compared to conventional hot stoves. Thus, the process can be run much more efficiently than was previously possible.

Moreover, the hot gases are always confined to the inner parts of the apparatus and away from the outer portions such as the cold collection chamber 106 and cold grid 110. As a consequence, the outer shell 108 of the apparatus as well as the cold grid 110 are always at moderate temperatures. With such a design, heat loss through the walls of the apparatus are lower than in an apparatus in which the hot parts are located close to the walls. In addition, because of the cylindrical geometry of the regenerator, parameters measured in the bed are uniform for a given radius from the axis of the unit.

In a further advantageous aspect of the invention, the blast phase can be carried out with an overpressure. Such an operation, typical when heating a blast furnace blast, advantageously results in an increase in the flow rate of the gas to be heated virtually proportional to the absolute pressure without adversely affecting heat transfer. If a blast furnace blast is produced, for example, at a pressure of less than 5 bar, the flow rate may reach 5000 $Nm^3/h \cdot m^2$ (2500 $kW/m^2$). With a regenerator having a grid surface area of 20 $m^2$, a hot blast flow rate of 100,000 $Nm^3/h$ can be produced. On the other hand, the gas phase will generally be carried out at normal pressure for economic reasons.

In order to ensure continuous operation of the regenerative heat exchanger apparatus to allow continuous production of the hot gases, it is particularly advantageous to employ a plurality of the heat exchangers. In such a case, the heat exchangers can be linked by a valve, piping and flow control to allow for proper control of the flow and pressure of the hot gas and blast gas in the heat exchangers.

The heat required by the exchangers can be supplied by a single combustion chamber. The combustion device should be sized appropriately to supply the plural units. Optionally, the burner can have multiple step setups, allowing it to be operated at several operating points. The use of a plurality of regenerators sharing the same combustion device is particularly beneficial in that the risk of damaging the refractory lining of the combustion chamber becomes less. Because the burner is almost never shut down, rapid and high temperature variations detrimental to the unit can be avoided.

Also to the goal of even distribution of gas through the heat accumulation bed, specially designed refractory bricks and hot grids formed therefrom can advantageously be used. While the invention is not to be limited to the use of these bricks and grids, such bricks and grids are described below, and are also the subject of U.S. application Ser. No. 09/525,117, attorney docket No. 000348-161, filed on even date herewith, the entire contents of which are incorporated herein by reference.

Figure 5D:
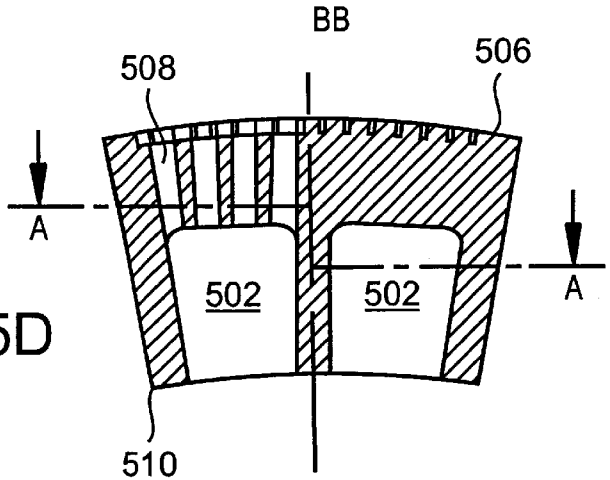
FIGS. 5A–E illustrate various views of a first exemplary brick design in accordance with the invention.
Figure 5E:
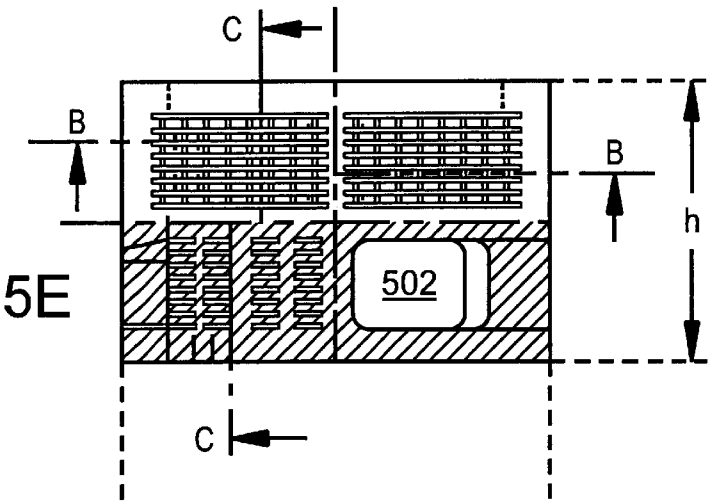
Figure 5A:
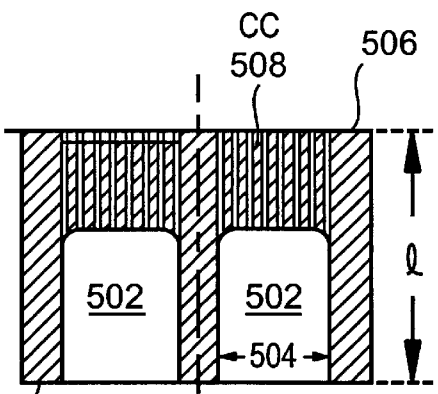
Figure 5B:
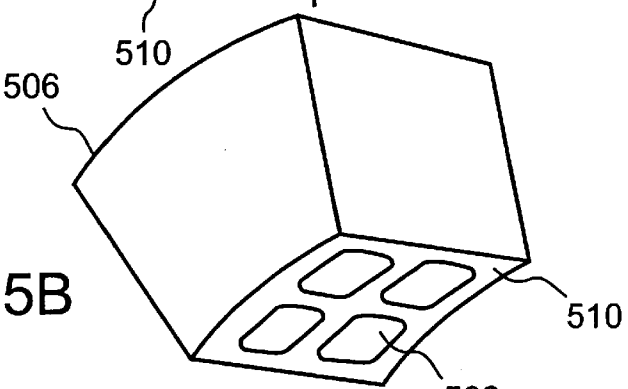
Figure 5C:
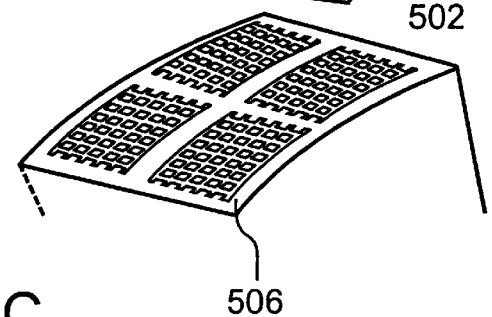

FIGS. 5A–E illustrate various views of an exemplary brick 500 of a first embodiment of the invention for use in a hot grid of a regenerative heat exchanger. FIG. 5E is a partial sectional view of the brick 500, while FIGS. 5A and 5D are cross-sectional views taken along lines C—C and B—B, respectively, of FIG. 5E. FIGS. 5B and 5C are plan views of the brick 500.

The high operating temperatures (e.g., greater than 600 and even greater than 1400° C. in some applications) and repeated stress cycles to which the bricks in the hot grid are subjected in the heat exchanger place extreme demands on that structure. The bricks and grid can either be strong enough to withstand the stress build-up or can be designed in such a way that it is self-adjusting to the stress build-up. This particular design relates to the former solution. The bricks and hot grid are thus of such a material and design to withstand temperature and stress variations to provide mechanical support to the particle bed by sustaining its geometry under such conditions. At the same time, the bricks and hot grid are of a design to be permeable to gases with a reasonable pressure drop and to be essentially unaffected by dust plugging. To achieve these goals, a macroscopically homogeneous structure which nevertheless has a good opening ratio for the gaseous streams is employed.

To withstand the temperature and stress variations required in the heat exchanger, the brick 500 is made of a refractory material, preferably refractory castable ceramics or refractory castable cement.

The geometry of the brick 500 allows for the formation of a cylindrical grid when the bricks are laid side-by-side with respect to sides 501, and when stacked to a desired height. Thus, the shape of the brick is preferably a sector of a circular ring of angle θ. Typically, the angle θ of the ring sector is from about 10 to 30°, more preferably about 16°. The brick 500 is typically of a length 1, measured from an inner face 510 to an outer face 506, of from about 10 to 80 cm, and of a height h of from about 15 to 50 cm.

The inner face 510 faces the inner hot collection chamber of the regenerator and the outer face 506 is in contact with the heat accumulation bed of the regenerator. The inner face 510 of the brick has at least one cavity 502, the cross-section of which can take various shapes. In the illustrated embodiment, the cross-section is generally rectangular. Preferably, the cross-section has a smaller dimension 504 greater than ten times the maximum diameter of the heat accumulation bed particles. Typically, the smaller dimension 504 of the cavity 502 is from about 4 to 15 cm. As shown in FIG. 5B, the exemplary brick has four cavities 502. If an individual brick has more than one cavity 502, each is preferably approximately equal in size, with the cavities being equally distributed over the inner face of the brick. These cavities typically extend for up to one half to two thirds the length 1 of the brick.

The outer portion of the brick, extending from the bottom of the cavities to the outer face 506 of the brick, is pierced by a plurality of longitudinal channels 508. Longitudinal channels 508 are fabricated in such a way that gases can freely circulate through the brick from the inner face 510 to the outer face 506 and vice versa. The bed particles are prevented from entering longitudinal channels 508 by proper sizing of the channels. In the exemplified embodiment, the longitudinal channels 508 are rectangular in cross-section, although other shapes are also envisioned. The smallest dimension of the longitudinal channels should not be larger than the diameter of the particles. In the case of the depicted rectangular channels, the larger dimension of the channels is preferably between five and ten times the smallest dimension. Typically, the smallest dimension is from about 0.3 to 1.5 cm, and the larger dimension is from about 1 to 8 cm.

The number of longitudinal channels 508 is selected to provide a suitable brick opening ratio while having sufficient material so as not to endanger the brick's mechanical properties.

Preferably, each individual brick is constructed from a single material and from a single piece of the material. Such a structure decreases the probability of a weak point in the brick by improving its homogeneity.

Figure 6A:
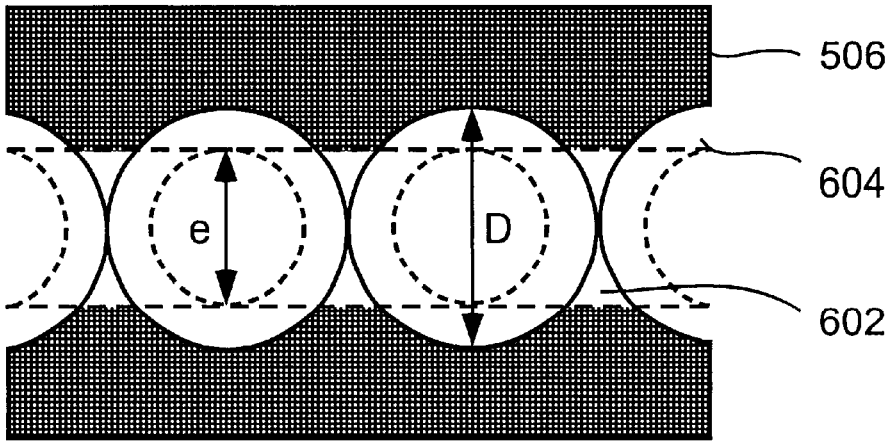
FIGS. 6A and 6B illustrate an outer face of the first exemplary brick design in accordance with the invention.
Figure 6B:
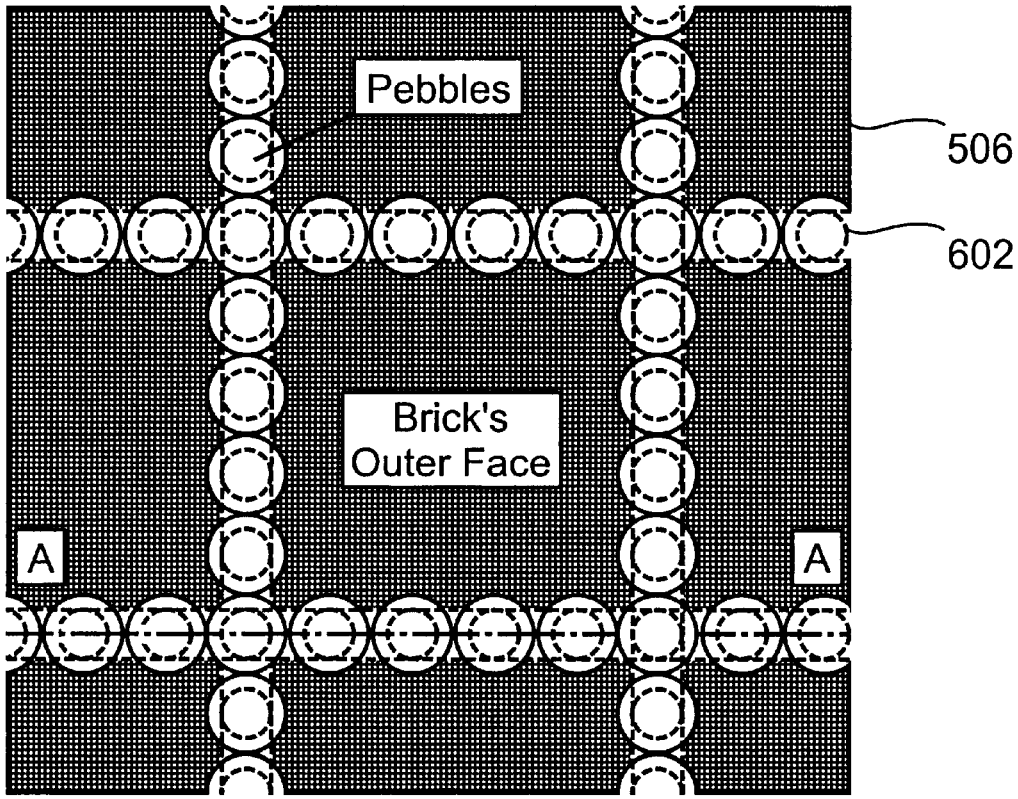

FIGS. 6A and 6B illustrate a preferred brick outer face design in accordance with a preferred aspect of the invention. To allow for a further decrease in pressure drop through the brick, a special channel profile can be employed in the outer face 506 of the brick where the longitudinal channels exit. It is particularly desirable to keep the opening section/brick section ratio within a reasonable range to guarantee proper mechanical properties of the hot grid. The free section seen by the gas flow up to at least the free section of the longitudinal channels can be increased by creating a network of shallow grooves 602 dug in outer face 506 of the brick. These grooves are typically a few millimeters deep, for example, from about 2 to 15 mm. Such a profile can effectively increase the free section seen by the gas. The brick preferably has a ratio of open area:closed area at the inner face of from 0.1:1 to 0.5:5, and a ratio of open area:closed area at the outer face of from 0.1:1 to 0.5:1.

In the case of spherical heat accumulation particles 604 in front of the groove 602, the free section seen by the gas is proportional to the opening section and can be understood from the following equation:

$$\frac{\text{free section}}{\text{opening section}} = 1 - \frac{\pi}{4} \cdot \frac{e}{D}$$

wherein:

e is the width of a groove, and

D is the diameter of the particles.

The sizes of the grooves 602 and other openings in the bricks are selected to be large enough such that dust plugging during use of the heat exchanger is not a concern. The opening sections of the channels and grooves should also be large enough such that clogging by minor dust accumulation phenomenon does not occur. The brick design shown in FIG. 5 results in a mechanically resistant and homogeneous hot grid which has a low pressure drop and is dust-proof.

Figure 7A:
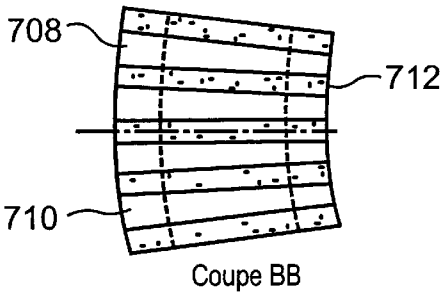
FIGS. 7A–E illustrate various views of a second exemplary brick design in accordance with the invention.
Figure 7B:
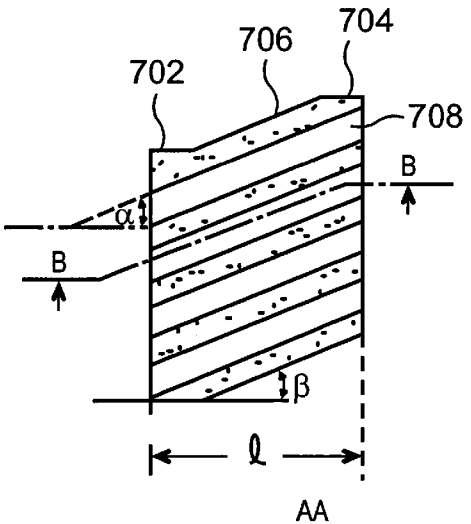
Figure 7C:
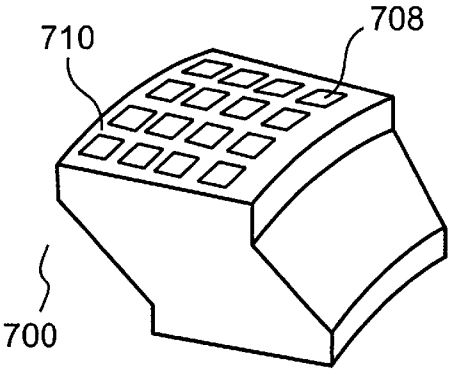
Figure 7D:
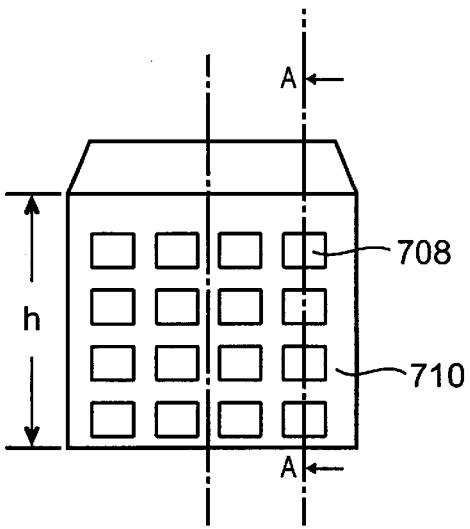
Figure 7E:
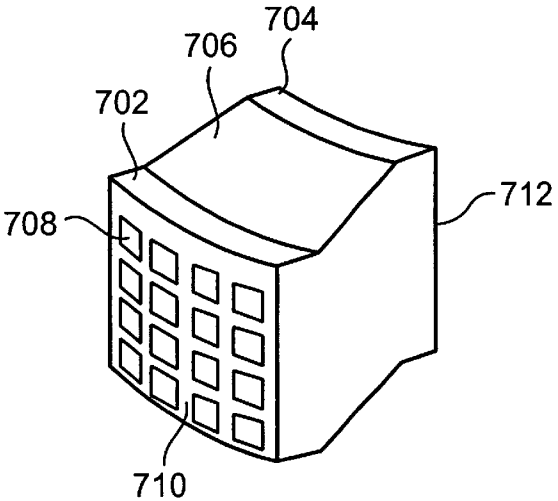

FIGS. 7A–E illustrate an exemplary brick 700 of a second embodiment of the invention. FIGS. 7C–E are various plan views of the brick 700, while FIG. 7B is a cross-sectional views taken along lines A—A of FIG. 7D. FIG. 7A is a cross-sectional views taken along lines B—B of FIG. 7B.

As with the first design, the brick and hot grid formed from the bricks should accommodate the possible stress build-up in the particle bed induced by the thermal cycling of the unit. This particular design, however, is self-adjusting to the stress build-up. In this embodiment of the invention, the brick 700 and hot grid formed therefrom are designed to allow the pebbles in the heat accumulation bed to expand freely in the radial direction without endangering the mechanical support function of the brick 700 or hot grid. The brick 700 and hot grid are designed in such a way that the particles making up the heat accumulation bed can freely move in the region of openings 708 formed therein.

This brick design is also advantageous for its ability to prevent the negative effects of dust accumulation in the hot grid. The hot grid formed from the bricks can be designed in such a way that particles of the heat accumulation bed are free to move in the region of the hot grid channel openings, with the blast stream kinetic energy creating limited particle movement in the hot grid region.

The overall design criteria for the brick 700 and hot grid in this embodiment are generally the same as used in the first embodiment, except for the provision of a free surface for the particles of the heat accumulation bed to move. Like the brick of the first embodiment, the brick 700 is made of a refractory a material, preferably refractory castable ceramics. The shape of the brick is preferably a sector of a circular ring of angle θ. Typically, the angle θ of the ring sector is from about 10 to 30°, more preferably about 16°. The brick 700 is typically of a length 1 of from about 15 to 80 cm, and of a height h of from about 30 to 50 cm.

At least one portion of the channel is not horizontal and makes an angle β with the horizontal, the slope increasing from the outer face 710 towards the inner face 712 of the brick 700. α is typically greater than 5°, preferably greater than 15°, and more preferably is approximately greater than or equal to the natural repose angle of the loose particles of the heat accumulation bed.

The brick 700 has at least one horizontal part 702, 704 and at least one non-horizontal, slanted part 706 with an angle β whose slope is positive in the direction towards the center of the heat exchanger unit, i.e., in the direction from outer face 710 to inner face 712. This allows for maintenance of a non-horizontal angle for the channels after stacking the bricks to form the grid. Angle β is preferably from about 5 to 50°. The channel angle a and the angle β of the slanted part of the brick are preferably the same. With β being 15°, the height h of the brick 700 would be about 39 cm (i.e., 35+15 tan (15°)). Slanted portion 706 is preferably disposed between two horizontal sections 702, 704. Each horizontal portion is preferably about 20% of the total length 1 of the brick.

At least one channel or cavity 708 penetrates through the brick from the inner face 712 to the outer face 710 of the brick 700. Typically, the brick 700 includes from about 1 to 50 channels 708, with the exemplified brick including 16 channels 708. The channels 708 are preferably distributed uniformly over the inner and outer faces 712, 710. Preferably, the ratio of open area:closed area at the inner face and the outer face is from 0.1:1 to 0.5:1.

The particles making up the heat accumulation bed when using this brick design preferably have a maximum diameter of 20 mm. The cross-section of the individual channels 708 is such that the loose bulk material particles can freely enter the channel without being stopped by any shape incompatibility. Preferably, the cross-sectional shape is rectangular. In the case of a rectangular channel cross-section, the channel has a smaller dimension x and a larger dimension y at the outer face 710 of the brick. The smaller dimension x of the channel 708 at the outer face 710 of the brick should be at least twice the maximum diameter of the loose bulk material particle, and is preferably from 5 to 10 times greater than the maximum diameter of the particles. The larger dimension y of the channel at the outer face is preferably from 2 to 10 times greater than the maximum diameter of the particles. Preferably, the smaller dimension x is from 2 to 20 cm, and the larger dimension y is from 2 to 25 cm. In the exemplary embodiment, the channel cross-section at the outer face 710 is 4.8×4.0 cm. Such a configuration allows the particles to expand freely, thereby releasing stress build-up during thermal cycling of the unit.

The gas velocity in the channels in the grid formed from the bricks should be lower then the fluidization speed limit of the particles in the heat accumulation bed. This can be accomplished by proper selection of the channel cross-section, which relates to the maximum diameter of the bed particles. The blast velocity V in the channels is given by the following equation:

$$V = \frac{Q_a}{3600} \cdot \frac{S_{Hot\,Grid}}{n_{Channel/Brick} \cdot N_{Brick} \cdot S_{Channel}}$$

wherein:

$Q_n$ is the actual (A) gas flow rate during the blast phase in $Am^3/(hr \cdot m^2$ of hot grid)

$n_{Chanel/Brick}$ is the number of channels per brick $N_{Brick}$ is the number of bricks in the hot grid $S_{Channel}$ is the cross-sectional area of an individual channel in $m^2$, and $S_{Hot\ Grid}$ is the surface area of the hot grid in $m^2$.

Figure 8:
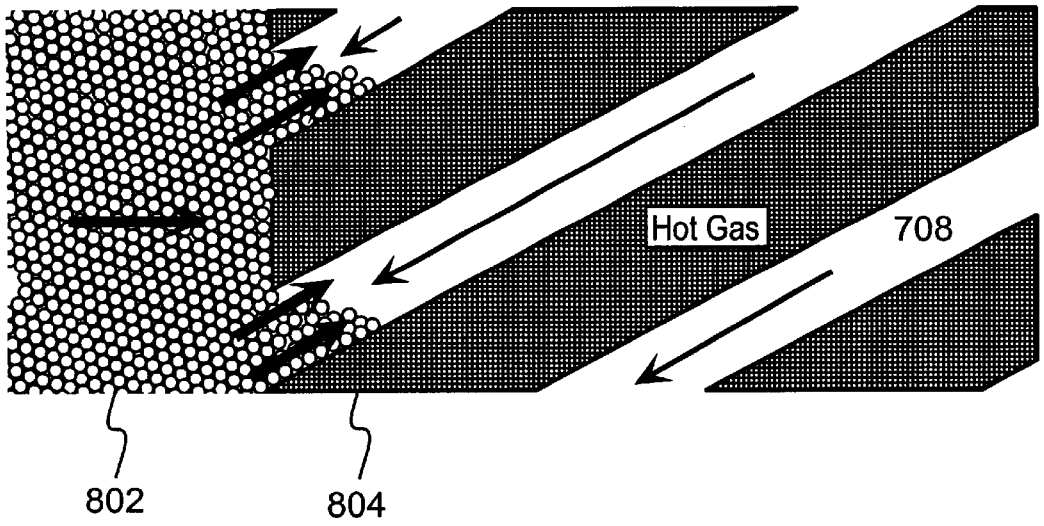
FIG. 8 illustrates in cross-section the second exemplary brick and particle bed in accordance with the invention during a blast phase.

FIG. 8 illustrates in cross-section a portion of a hot grid formed from a plurality of bricks 700 of the second embodiment and a heat accumulation bed 802 during the gas phase. During the gas phase, the average temperature of the particles in the heat accumulation bed increases. The particles of the bed 802 tend to expand due to the increase in temperature. As a result, they apply a radially compressive stress on the bricks 700 in the hot grid. Because the particles are free to move radially by their ability to enter the channels of the hot grid, the stress field is thereby released.

Figure 9:
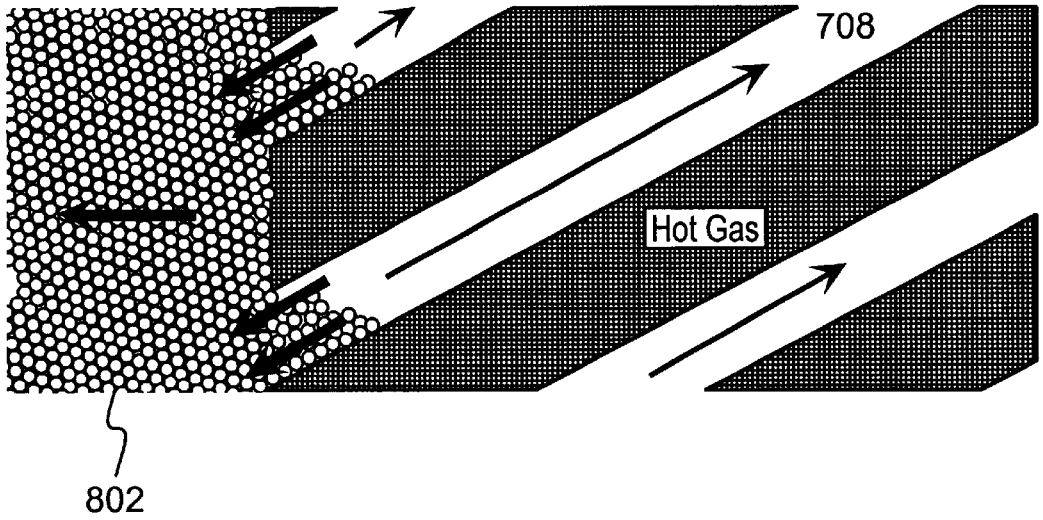
FIG. 9 illustrates in cross-section the second exemplary brick and particle bed in accordance with the invention during a gas phase.

FIG. 9 illustrates in cross-section a portion of a hot grid formed from a plurality of bricks 700 of the second embodiment and a heat accumulation bed 802 during the blast phase. During the blast phase, contraction of the particles in the heat accumulation bed 802 occurs and the particles in the channels 708 tend to move back towards the core of the bed due to the slope of the channels. This contraction, however, may not totally compensate for the previous expansion occurring during the gas phase. In such a case, the channels may fill up with particles from the bed over time. Some of the particles may then fall into the hot collection chamber where they can easily be collected.

In accordance with a preferred aspect of the invention, the cross-section of the individual channels at the outer face of the brick is such that the gas velocity V in the channel during the blast phase is lower than the pneumatic fluidization speed of the particles in the heat accumulation bed $V_{el}$ and greater than the Ledoux Velocity $V_L$:

$$V_L < V < V_{el}$$

wherein the Ledoux Velocity $V_L$ is defined according to the following equation:

$$V_L = 0.4 \cdot \sqrt{\frac{D \cdot \rho_L}{\rho_g}}$$

in which:

D is the diameter of the heat accumulation particles $\rho_b$ is the bed volumetric weight (kg.m$^{-3}$), and $\rho_g$ is the gas volumetric weight (kg.m$^{-3}$).

The blast velocity V in the channels is given by the following equation:

$$V = \frac{Q_a}{3600} \cdot \frac{S_{Hot\,Grid}}{n_{Channel/Brick} \cdot N_{Brick} \cdot S_{Channel}}$$

wherein:

$Q_n$ is the actual (A) gas flow rate during the blast phase in Am$^3$/hr·m$^2$ of hot grid $n_{Channel/Brick}$ is the number of channels per brick $N_{Brick}$ is the number of bricks in the hot grid $S_{Channel}$ is the cross-sectional area of an individual channel in m$^2$, and $S_{Hot\,Grid}$ is the surface area of the hot grid in m$^2$.

Preferably the blast velocity V is approximately equal to two times the Ledoux Velocity $V_L$. Due to the choice of the particular gas velocity range defined above for the blast flow during the blast phase, some particles of the heat accumulation loose bulk material can be drawn up into the channels by the blast stream. Since the blast velocity is well below the fluidization speed for this material, the blast keeps the particles of the bed agitated in the proximity of the hot grid, with relatively few particles being carried by the blast stream.

As the particles travel upwards through the channels, the blast velocity decreases. At the very inlet of the channels, the actual gas velocity seen by the particles is provided by the following formula:

$$V_{inlet} = \frac{Q_a}{3600 \cdot s'}$$

wherein s' is the free cross-sectional area of the opening in m$^2$. s' is typically about 55% of the entire cross- section because of the partial obstruction of the opening by the particles of the heat accumulation bed.

Since only one or two particles are typically present in the channel cross-section at higher points, the free opening is generally significantly larger and the actual velocity of the blast drops. This effect can optionally be enhanced by increasing the height of the individual channels towards the inner face of the brick. Whereas the channel width decreases slightly due to the design of the brick, the increase in height can keep the cross-sectional area constant and can even increase it, depending on the selected enlargement rate. Because of the decrease in velocity of the blast stream, the conditions drop below the point at which the particles can be transported in the stream. Consequently, the particles fall to the bottom of the channel and roll back downwards to the heat accumulation bed. Any particles traveling to the end of the channel fall to the bottom of the hot collection chamber due to the low gas velocity therein.

Agitation of the particles in the manner described effectively prevents gluing together of the particles by the dust load of the gases. As a result, the brick design effectively lessens the danger of an increasing pressure drop over time through dust plugging.

The invention is in no way limited to the exemplary brick designs described above, and other designs for the brick are also envisioned. For example, in the brick design of the second embodiment, the channels can have more than one non-horizontal portion having different angles for each such portion. Such a structure can better limit the total number of particles exiting the hot grid by making it more difficult for particles to travel through the entire length of the channels.

Preferably, the hot grid formed from the above-described bricks are cylindrical in shape, with the bricks being held together, for example, with refractory mortar or cement.

Figure 10:
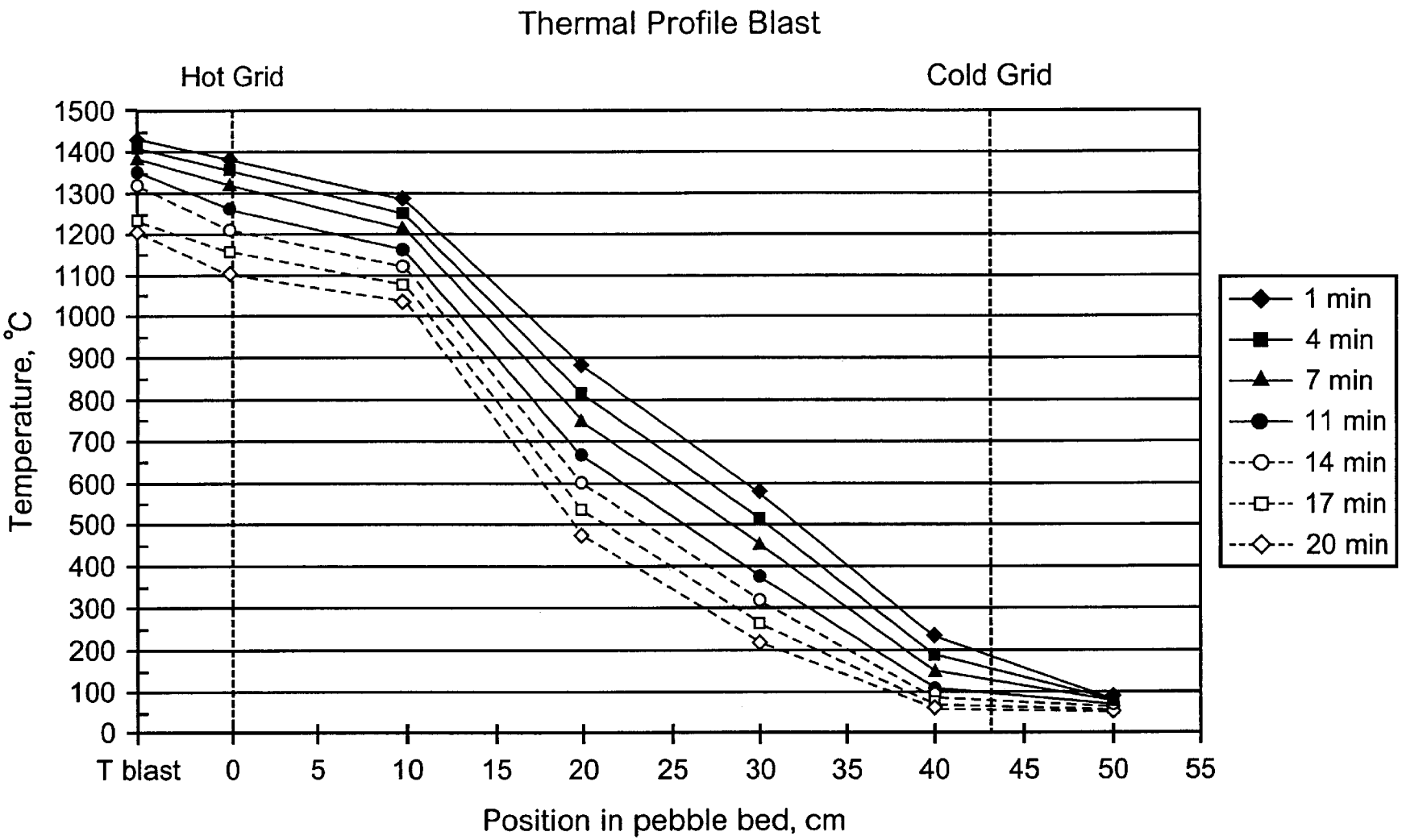
FIG. 10 is a graph of temperature versus radial position in the heat accumulation bed.

FIG. 10 is a graph of temperature versus radial position in the heat accumulation bed, and illustrates the thermal profiles of the apparatus in accordance with the invention during a blast phase for various times. As can be seen from this figure, the thermal profile is S-shaped. This is in contrast to conventional air heaters which have vertical circulation and which possess an essentially linear-shaped thermal profile. The S-shaped temperature distribution has the first advantage that the temperature drop of the hot blast during the cold blowing phase is small compared to the variation in the average temperature of the entire material bed, which is generally greater than 200° C., and preferably greater than 400° C. In contrast, the variation in average temperature in known air heaters is approximately 100° C. As a result, the apparatus in accordance with the invention stores approximately four times more heat energy than conventional systems. This result makes it possible to considerably reduce the heat accumulation mass used in the unit.

The S-distribution of the temperature depends not only on the prescribed particle size of the particles in the bed, but also on the minimum determined gas flow rate. This minimum flow rate corresponds to a power of 300 Nm$^3$/h·m$^2$. This corresponds, for a blast temperature of 1200° C. to a specific power of 150 kW/m$^2$, which is the minimum suitable in this method. When the power increases, the S-profile of the temperature becomes increasingly pronounced. A particularly advantageous operating point appears for a flow capacity of 1000 Nm$^3$/h·m$^2$, and a pressure drop of 1000 to 1600 Pa. An increase in the flow rate up to 2000 Nm$^3$/h·m$^2$ is possible without decreasing the heat transfer, considering a head loss of 3000 to 5000 Pa. This power limit is applicable to running under normal pressure.

It was observed during operation of the regenerator in accordance with the invention that the temperature of the initial hot blast was only from 20 to 50° C. below the theoretical flame temperature, and that the hot blast temperature did not vary by more than 150° C. throughout the blast phase. This indicates that even in the case of a temperature drop, an improvement by a factor of 10 has been achieved. Depending on size and design of the regenerator, the thermal efficiency can be raised from 70 to 85% (inversion included) for conventional air heaters to 80 to 95% (inversion excluded) for the regenerator according to the invention.

While the invention has been described in detail with reference to specific embodiments thereof, it will be apparent to one skilled in the art that various changes and modifications can be made, and equivalents employed, without departing from the scope of the appended claims.

What is claimed is:

1. A regenerative heat exchanger, comprising:

a chamber separated into a plurality of annular concentric spaces, comprising: a first, inner annular space defining a hot collection chamber; a second, outer annular space concentric to and around the first space defining a cold collection chamber; and a third annular space defining a heat exchange zone concentric to and between the first and second spaces, the beat exchange zone containing a particulate heat transfer material, wherein the third space is supported on the inside by a concentrically disposed hot grid, the external diameter of the third annular space is less than about double the internal diameter of the third annular space; and a combustion chamber at least substantially disposed within the hot collection chamber.

2. The regenerative heat exchanger according to claim 1, wherein the particle diameter of the heat transfer material is less than about 20 mm.

3. The regenerative heat exchanger according to claim 1, wherein the heat exchanger has a diameter of from about 3 to 8 meters and a height of from about 3 to 20 meters.

4. The regenerative heat exchanger according to claim 1, further comprising a combustion chamber for providing a hot gas to heat the heat transfer material.

5. The regenerative heat exchanger according to claim 4, wherein the combustion chamber is disposed at least partially within the hot collection chamber.

6. The regenerative heat exchanger according to claim 1, wherein the combustion chamber is disposed below the hot collection chamber.

7. The regenerative heat exchanger according to claim 1, further comprising an insulating lid over the first space for sealing the hot collection chamber, and a controller for opening at least a portion of the lid, thereby allowing heat to be released from the heat transfer material upon occurrence of an abnormal operating condition.

8. The regenerative heat exchanger according to claim 1, wherein the hot grid comprises a plurality of gas permeable bricks of a refractory material, the bricks comprising an inner face and an outer face on opposite sides of the brick, one or more cavities extending from the inner face partially into the brick, and a plurality of channels for each of the cavities extending from the outer face to the cavities, the cavities and channels allowing a gas to pass through the brick.

9. The regenerative heat exchanger according to claim 8, further comprising a plurality of grooves in the outer face overlapping the channels.

10. A method for heating a gas in the regenerative heat exchanger according to claim 1, comprising passing a hot gas from the first annular space through the hot grid and the third annular space, thereby heating the heat transfer material, and subsequently passing a gas to be heated from the second annular space through the third annular space and the hot grid into the first annular space, thereby heating the gas to be heated.

11. The method according to claim 10, wherein flow of the hot gas and the gas to be heated is substantially uniform at a given radius from the central axis of the first annular space along the height thereof.

12. The method according to claim 10, further comprising feeding the hot gas to a blast furnace.

13. The method according to claim 10, wherein the temperature distribution of the third annular space along a radial direction is essentially S-shaped.

14. The method according to claim 10, further comprising conducting a first inversion to raise the pressure in the heat exchanger from a first pressure at which the step of passing the hot gas is conducted to a second pressure at which the step of passing the gas to be heated is conducted, the inversion being conducted between said steps.

15. The method according to claim 14, wherein the inversion period is from about three seconds to five minutes.

16. A regenerative heat exchanger, comprising:

a chamber separated into a plurality of annular concentric spaces, comprising: a first, inner annular space defining a hot collection chamber; a second, outer annular space concentric to and around the first space defining a cold collection chamber; and a third annular space defining a heat exchange zone concentric to and between the first and second spaces, the heat exchange zone containing a particulate heat transfer material, wherein the third space is supported on the inside by a concentrically disposed hot grid; and a combustion chamber at least substantially disposed within the hot collection chamber.

17. The regenerative heat exchanger according to claim 16, wherein the particle diameter of the heat transfer material is less than about 20 mm.

18. The regenerative heat exchanger according to claim 16, wherein the heat exchanger has a diameter of from about 3 to 8 meters and a height of from about 3 to 20 meters.

19. The regenerative heat exchanger according to claim 16, further comprising an insulating lid over the first space for sealing the hot collection chamber, and a controller for opening at least a portion of the lid, thereby allowing heat to be released from the heat transfer material upon occurrence of an abnormal operating condition.

20. The regenerative heat exchanger according to claim 16, wherein the hot grid comprises a plurality of gas permeable bricks of a refractory material, the bricks comprising an inner face and an outer face on opposite sides of the brick, one or more cavities extending from the inner face partially into the brick, and a plurality of channels for each of the cavities extending from the outer face to the cavities, the cavities and channels allowing a gas to pass through the brick.

21. The regenerative heat exchanger according to claim 20, further comprising a plurality of grooves in the outer face overlapping the channels.

22. A method for heating a gas in the regenerative heat exchanger according to claim 16, comprising passing a hot gas from the first annular space through the hot grid and the third annular space, thereby heating the heat transfer material, and subsequently passing a gas to be heated from the second annular space through the third annular space and the hot grid into the first annular space, thereby heating the gas to be heated.

23. The method according to claim 22, wherein flow of the hot gas and the gas to be heated is substantially uniform at a given radius from the central axis of the first annular space along the height thereof.

24. The method according to claim 22, further comprising feeding the hot gas to a blast furnace.

25. The method according to claim 22, wherein the temperature distribution of the third annular space along a radial direction is essentially S-shaped.

26. The method according to claim 22, further comprising conducting a first inversion to raise the pressure in the heat exchanger from a first pressure at which the step of passing the hot gas is conducted to a second pressure at which the step of passing the gas to be heated is conducted, the inversion being conducted between said steps.

27. The method according to claim 26, wherein the inversion period is from about three seconds to five minutes.

* * * * *